United States Patent [19]

Keesee et al.

[11] Patent Number: 4,512,132

[45] Date of Patent: Apr. 23, 1985

[54] PORTABLE EARTH ANCHOR

[75] Inventors: Kenneth C. Keesee, Smoot; James A. Ruckman, Lewisburg, both of W. Va.

[73] Assignee: Westvaco Corporation, New York, N.Y.

[21] Appl. No.: 492,257

[22] Filed: Jun. 3, 1983

Related U.S. Application Data

[62] Division of Ser. No. 268,774, Jun. 1, 1981, Pat. No. 4,406,100.

[51] Int. Cl.[3] ..... E02D 5/74

[52] U.S. Cl. ..... 52/742; 52/745; 264/31

[58] Field of Search ..... 52/111, 119, 120, 143, 52/166, 148–155, 600, 742, 745; 104/117, 123; 188/7; 264/31; 212/189, 145, 95, 119

[56] References Cited

U.S. PATENT DOCUMENTS 1,734,882 11/1929 Sayers ..... 52/120

2,694,474 11/1954 Meany ..... 52/120

FOREIGN PATENT DOCUMENTS 1148143 6/1957 France ..... 52/600

*Primary Examiner*—James L. Ridgill, Jr.

*Attorney, Agent, or Firm*—W. A. Marcontell; R. L. Schmalz

[57] ABSTRACT

A portable earth anchor and foundation pier is provided by a reinforced concrete casting around a steel skeleton comprising wheel axles, draw bar and earth penetrating tines. One embodiment of the invention has ground clearance from a bottom surface for wheel support in a first, transport position. The tines project from the top surface. When inverted for earth penetration by the tines, the transport wheels are positioned out of ground contact.

1 Claim, 16 Drawing Figures

PORTABLE EARTH ANCHOR

This is a division of application Ser. No. 268,774, filed June 1, 1981, now U.S. Pat. No. 4,406,100, issued Sept. 27, 1983.

BACKGROUND OF THE INVENTION

1. Field of the Invention

The present invention relates to portable earth anchors and foundation piers. In particular, the present invention is directed to a transportable guy wire anchor for logging cable yarders.

2. Description of the Prior Art

Cable logging is a technique frequently used for removing felled trees from rough, mountainous terrain whereby a skyline cable is drawn over a sheave block near the top of a yarder mast and out from the mast over a cutting area. The distal end of the skyline is secured to the ground at a point remote from the yarder; occasionally after passing over a tail block secured to the top of second, remote end mast.

The primary skyline cable carries a sheave mounted carriage block from which a load line is dropped for picking up the load.

In this system, the yarder is a portable, usually truck mounted, power unit associated with a mast structure for driving and controlling several cable winches necessary for reeling and tensioning the skyline, load and carriage traverse cables.

Obviously, all vertical loads on a cable system are supported compressively by the mast. However, the mast, being truck mounted, has relatively little moment restraint against lateral loads. For this reason, the mast is secured laterally by guy wires tensioned from the mast to a ground anchor.

As a logging operation progresses, it is necessary to frequently realign or move the cable system. Even if the yarder and mast are not physically transposed, the skyline tail will be aligned along a different azimuth to service a different radial segment of terrain from the yarder center. Such change in azimuth alignment will also require a repositioning of anchor points for the guy wires and dead lines from the mast sheave blocks.

If possible, cable system riggers seek out a large tree or stump for ground anchorage of guy wires and dead lines. However, considering the number of anchor points required for a system against the allowable cone of discretion for each, a suitable tree stump is not always available. In the absence of a suitable anchor tree or stump, the prior art practice is to secure the anchor line around a sizable log for burial at approximately six feet. Although excavating equipment such as backhoes and crawler/scrapers are normally present at logging sites for such tasks, bed rock and massive boulders underlying thin, mountainous topsoil greatly complicate the excavation task.

Collectively, therefore, appropriate anchorage of a cable system represents one of the more perplexing and frequently recurring problems in the cable riggers art and to which the present invention is addressed.

Accordingly, it is an object of the present invention to teach a method of anchoring cable systems that is as portable as the yarder and applicable to most types of forested mountain terrain.

Another object of the present invention is provision of a transportable anchor pier having sufficient mass and ground adherence to secure cable logging guy wires and dead lines.

Another object of the present invention is provision of a multiple purpose pier for logging operations that may be used for small stream and gully bridge foundations and for anchoring skyline cable log retrieving systems.

SUMMARY OF THE INVENTION

These and other objects of the invention are accomplished by means of a concrete casting about a wheel mounted, T-frame trailer. The leg of the trailer T-frame projects beyond the casting to serve as a draft bar. Heavy duty truck wheels having load capacity suitable to the approximate 12 ton weight of the vehicle are secured to opposite ends of the T-frame cross-bar prior to casting so that the load carrying wheel bearing tubes project deeply into the cast mass. Vertical positioning of the wheel axis is such to permit adequate wheel surface clearance in the transport mode. Inversion of the vehicle, however, positions the wheels out of ground contact so that the vehicle weight is concentrated on several raked, ground penetrating tines or spikes which are secured to the T-frame and project beyond the upper cast surface of the vehicle.

A steel-lined tubular space is provided through the approximate vehicle center from top to bottom surfaces for the purpose of threading an anchor cable loop. In the preferred disposition, the rake of the ground spikes is aligned toward the load end of the anchored cable whereby any attempt to drag the anchor will set the spikes into the ground more deeply and securely.

Application of the present invention comprehends that the anchor draft bar is secured to a wheel-skidder and pulled in the transport mode to a desired anchor point. A cable loop is threaded through the anchor tube and the anchor upended onto its spiked surface.

In an alternative application, two or more of the anchors may be positioned in the bed of a small stream or gully as bridge piers to support girders and planking. When need for the bridge has passed, the anchors may be pulled out and drawn to new locations for further use, either as a cable anchor or again as a bridge pier.

BRIEF DESCRIPTION OF THE DRAWINGS

Relative to the drawings wherein like reference characters designate like or similar elements throughout the several figures of the drawings.

DESCRIPTION OF THE PREFERRED EMBODIMENTS

Figure 1:
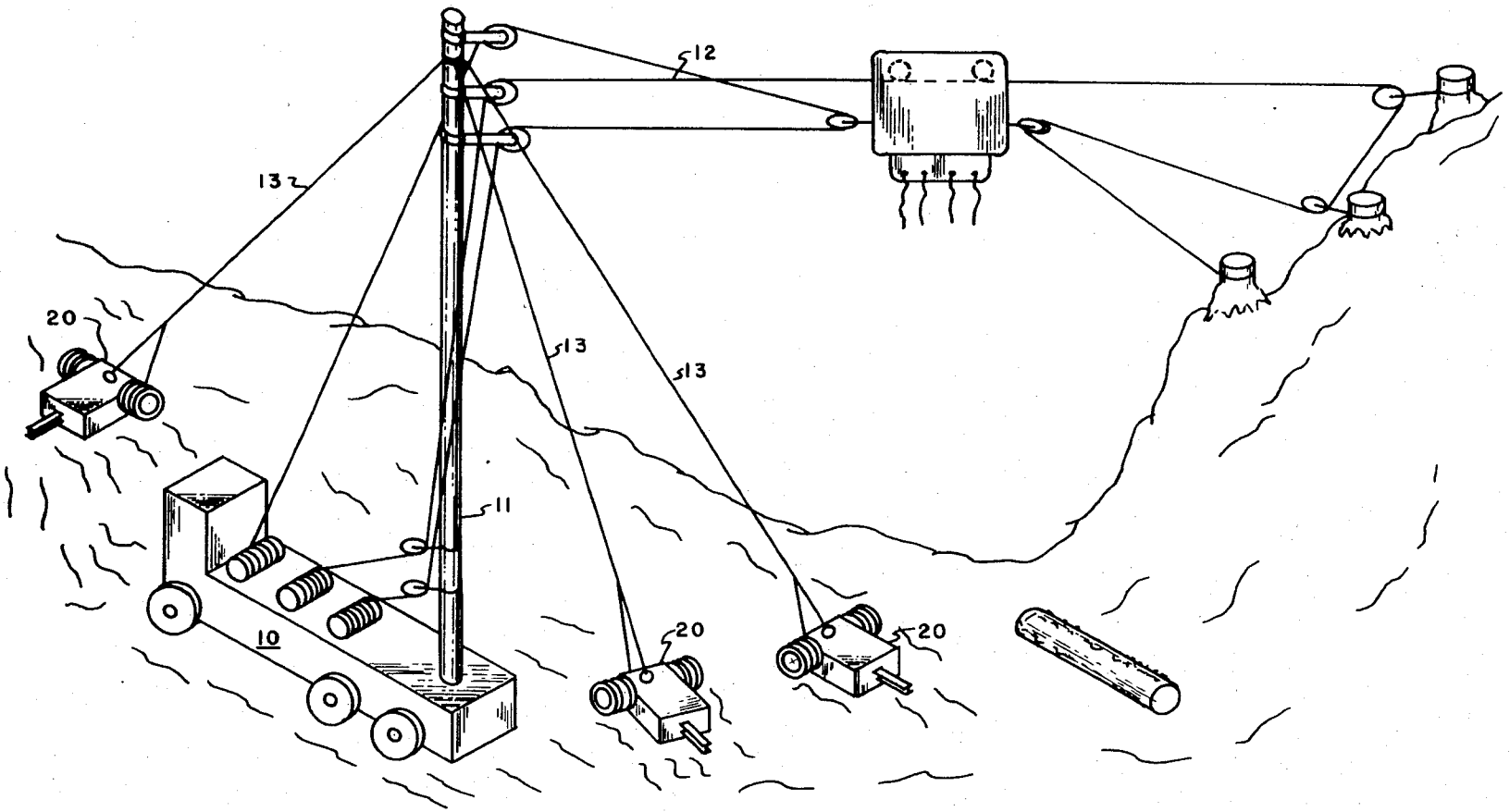
FIG. 1 is a pictorial representation of the invention in an operative disposition.

The pictorial of FIG. 1 illustrates the originally conceived environment of the invention which is a mountainous logging site served by a skyline cable logging system.

Mast 11 is associated with the yarder 10 to support the live end of the cable 12. Guy wires 13 are tightly tensioned between the mast top and the present invention anchor piers 20.

Figure 4:
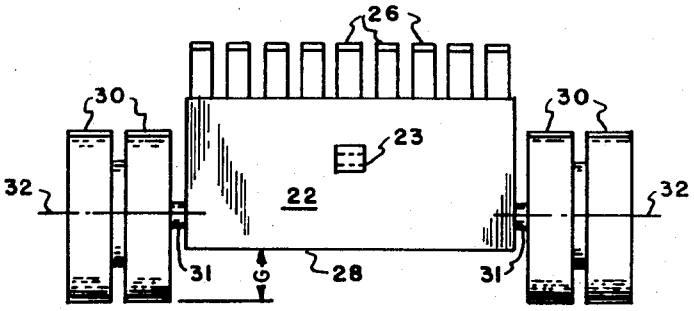
FIG. 4 is an orthographic end elevation of the invention.
Figure 3:
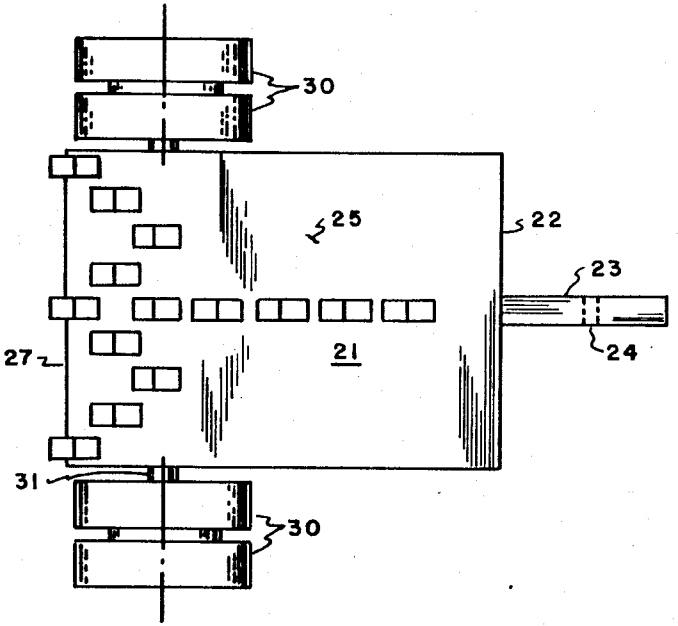
FIG. 3 is an orthographic top plan of the invention.
Figure 2:
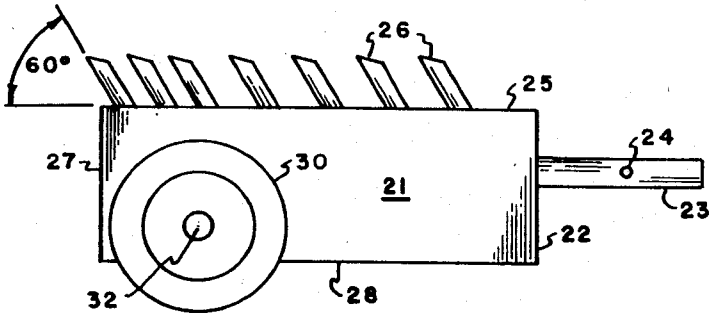
FIG. 2 is an orthographic side elevation of the invention.

FIGS. 2, 3 and 4 illustrate the prime embodiment of the invention which basically comprises a substantially solid concrete body block 21 having a front end 22 from which projects a draft bar 23. A tubular aperture 24 through the draft bar 23 accommodates a lift and tow tether.

From the top 25 of the body block 21 projects a multiplicity of ground engaging spikes 26 raked at an approximately 60° angle toward the block back 27. Projection distance above the top surface 25 is not critical but one foot is representative.

Figure 5:
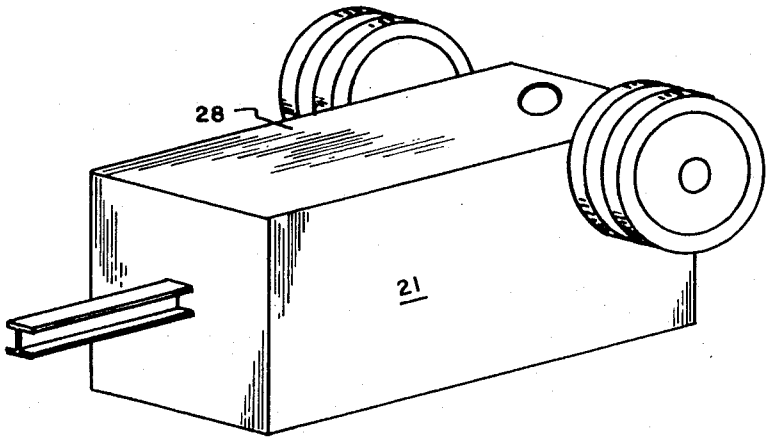
FIG. 5 is an isometric view of the invention in operative position.

Wheels 30 are removably mounted on hubs 30*a* rotatively secured to bearing tubes 31. The bearing tubes are set into the body block 21 with the wheel axis 32 positioned above the block bottom 28 that distance required for adequate ground clearance G, usually about 9 to 12 inches. Essential is the condition that the wheels 30 be completely clear of the ground when the body block 21 is inverted to the bottom side 28 up position illustrated by FIG. 5. Preferably, the bearing tube axis 32 is positioned between the top and bottom surfaces 25 and 28 and relative to the bottom surface 28 so that no portion of the hub 30*a* projects into the spacial plane of the top 25.

Figure 8:
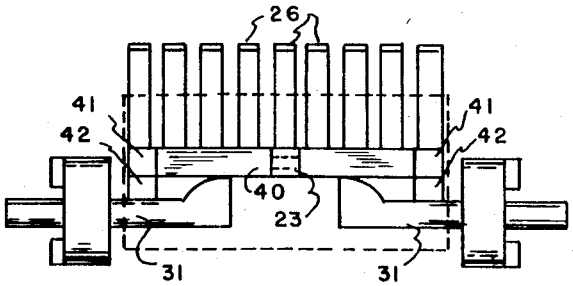
FIG. 8 is an end elevation of the skeletal structure of the invention.
Figure 7:
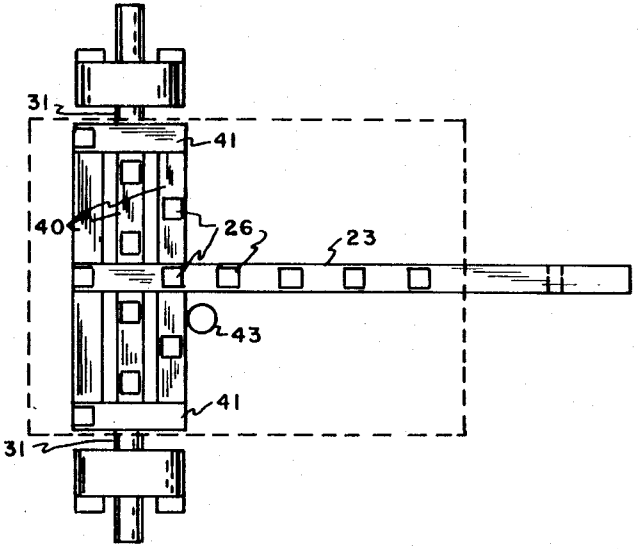
FIG. 7 is a top plan of the skeletal structure of the invention.
Figure 6:
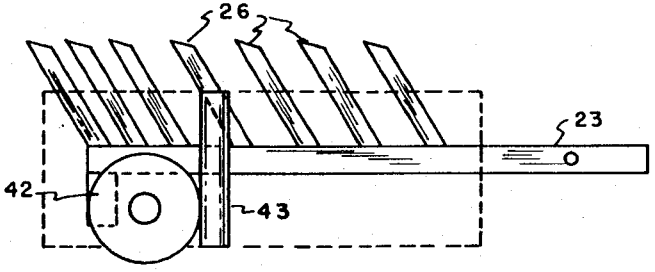
FIG. 6 is a side elevation of the skeletal structure of the invention.
Figure 10:
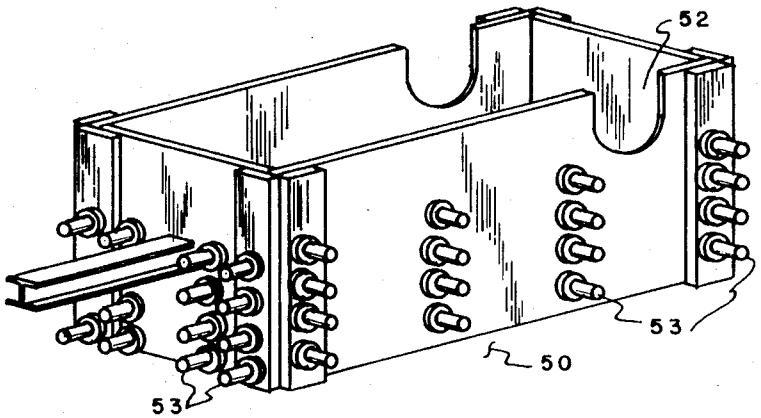
FIG. 10 is an isometric view of a concrete casting form for the invention.

Internal construction of the body block 21 is illustrated by FIGS. 6, 7 and 8. The draft bar 23 is a structural H-section that extends substantially the full length of the body block 21. In the vicinity of the wheel bearing tubes 31, H-section cross-members 40 are welded to the draft bar 23 and to respective end braces 41. Downcomer braces 42 welded to the end braces are positioned behind the wheel bearing tubes 31.

Ground spikes 26 are welded to the draft bar 23 and the cross-braces 40 in the pattern shown by FIG. 7.

A heavy wall pipe section 43 welded to both, the draft bar 23 and the forward cross-brace 40 at the intersection therebetween will form and sleeve the tether loop aperture.

Although specially fabricated wheel bearing tubes 31 may be used, it is most economical to utilize a heavy truck drive axle housing that has been stripped of the drive components. The banjo housing for the drive wheel differential serves as an ideal load distributor to the subsequently cast concrete mass of the body block 21.

Figure 9:
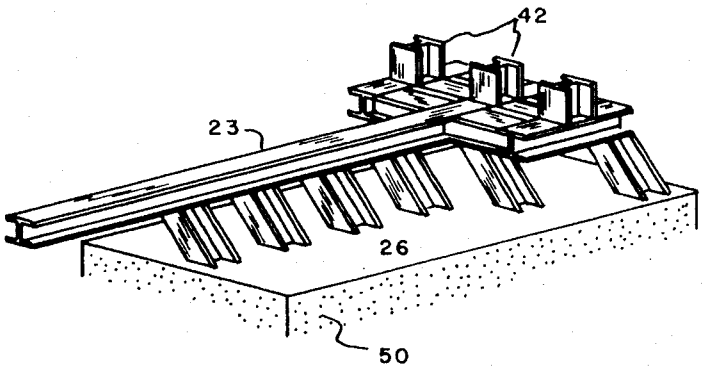
FIG. 9 is an isometric view of the invention in a state of partial fabrication.

Fabrication of the invention begins with construction of the T-frame which comprises the draft bar 23, the cross-braces 40, the ground spikes 26 and other bracing structure integral therewith. With the skeletal framework complete, the assembly is inverted and leveled upon the ground spikes 26. Relative to FIG. 9, a sand bed 50 is packed around the spikes 26 to the desired level of spike exposure.

Next, a concrete form box 51 is assembled around the skeletal frame and level aligned relative thereto. Correctly positioned notches 52 are cut into the form box sides to receive the wheel bearing tubes 31 which are also leveled, aligned and the open notch remainder plugged.

All essential components of the anchor being aligned and secured, a matrix of reinforcing bars 53 is constructed within the remaining form box space.

An anchor body block 21 having length width and height dimensions of 8 feet, 6 feet and 3 feet, respectively will require approximately five and one-half cubic yards of concrete thoroughly tamped and vibrated into and around the internal steel-work aforedescribed. Seven days of damp cure are normally adequate prior to form removal. Thereafter, the anchor is ready for use upon form removal, wheel mounting and cutting of the reinforcing bar 53 projections. The completed anchor is tethered by a cable between the draft bar 23 and an appropriate vehicle such as a wheel skidder and upended by rolling over the back end 27 onto the wheels 30.

Figure 13:
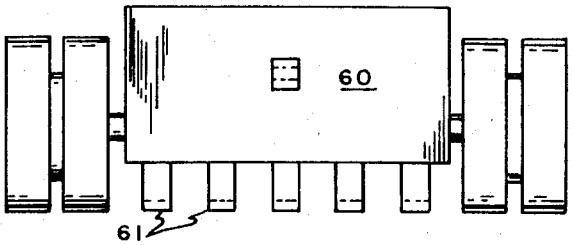
FIG. 13 is an end elevation of the invention alternative embodiment.
Figure 12:
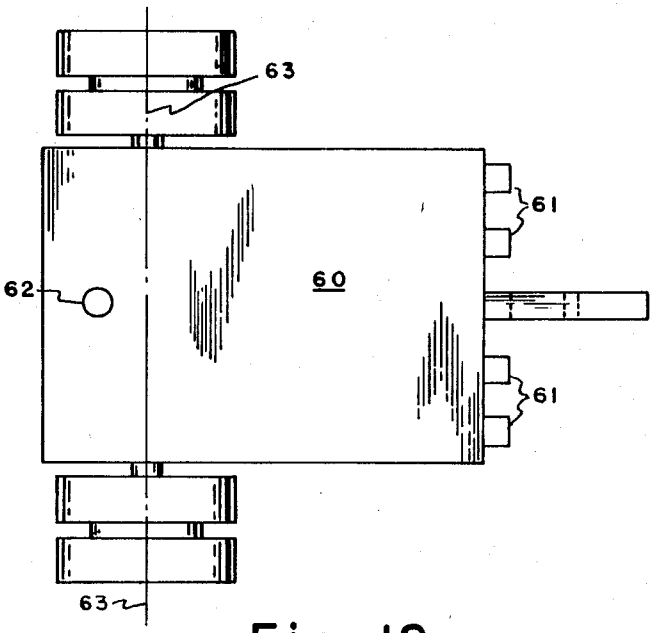
FIG. 12 is a top plan of the invention alternative embodiment.
Figure 11:
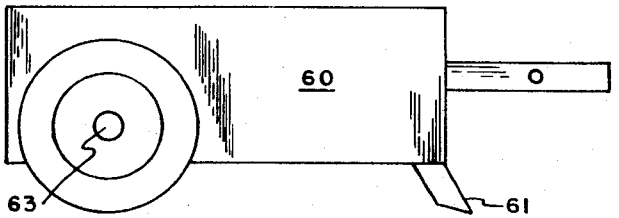
FIG. 11 is a side elevation of an alternative embodiment of the invention.

FIGS. 11, 12 and 13 illustrate an alternative embodiment of the invention suitable for application in those circumstances wherein obstructions or insufficient space prohibit the end-over-end inversion of the anchor.

The body block of anchor 60 is substantially the same weight and configuration as previously described block 21. However, the ground spikes 61 of the FIG. 11 embodiment are limited to a single row across the front, bottom edge of the block. The tether loop aperture 62 is positioned as near the block back face as structurally prudent and behind the wheel axis 63.

Figure 15:
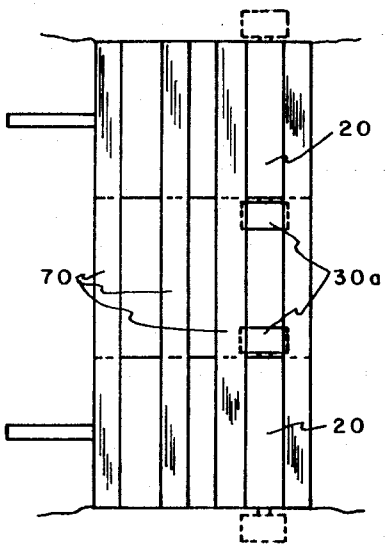
FIG. 15 is a top plan of the invention disposed in the stream bed bridge pier utility mode; and, FIG. 16 is an end elevation of the invention disposed in a stream bed bridge pier utility mode.
Figure 14:
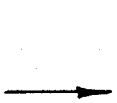
FIG. 14 is a side elevation of the invention disposed in a stream bed bridge pier utility mode.
Figure 14:
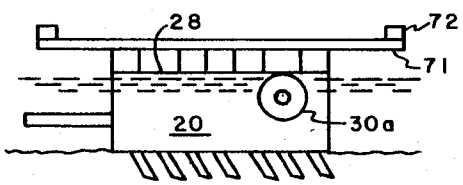
Figure 16:
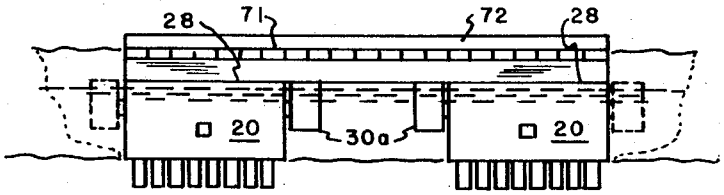

Flexibility of the present invention as a logging site tool is illustrated by FIGS. 14, 15 and 16 where two of the FIG. 2 embodiment anchors 20 are set on respective sides of a stream bed. With the wheels 30 removed, hubs 30*a* do not obstruct the planar continuity of block bottom surface 28 thereby permitting bridge stringers 70 to be laid across the anchors 20 as a foundation pier. With decking 71 and curbing 72, a useful temporary bridge is quickly assembled for vehicular crossing of small streams, gullys and washes.

Having fully described our invention, its alternative embodiments and uses, others will perceive additional uses or construction techniques. As our invention, however,

We claim:

1. A method of stabilizing a portable mast comprising the steps of:

A. Providing a plurality of ground wheel supported, reinforced concrete anchor means having ground penetrating spike means projecting upwardly from top surfaces thereof;

B. Erecting said mast at a suitable, desired location;

C. Connecting one end of guy wires to and proximate of the top of said mast;

D. Rolling at least one of said anchor means to a desired anchor location respective to a guy wire;

E. Inverting said anchor means to sequentially disengage said support wheels from the support ground and engage said spike means with the support ground;

F. Setting said spike means to restrain guy wire tension forces; and,

G. Securing the other end of said guy wire to said anchor means.

* * * * *